US008710409B2

(12) United States Patent
Busalt et al.

(10) Patent No.: US 8,710,409 B2
(45) Date of Patent: Apr. 29, 2014

(54) MOTORIZED HOME APPLIANCE DOOR

(75) Inventors: Gerhard Busalt, Allenmarkt/Alz (DE); Joachim Grützke, Egmating (DE); Graham Sadtler, Huntington Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 291 days.

(21) Appl. No.: 12/971,102

(22) Filed: Dec. 17, 2010

(65) Prior Publication Data

US 2012/0153787 A1 Jun. 21, 2012

(51) Int. Cl.
*A41B 1/00* (2006.01)
*F23M 7/00* (2006.01)

(52) U.S. Cl.
USPC ..... 219/402; 126/192; 312/236

(58) Field of Classification Search
USPC ..... 219/402, 391, 392; 126/192, 190, 194, 126/198, 332, 337 R, 339; 160/188, 201, 160/207; 312/236, 319.5
See application file for complete search history.

(56) References Cited

U.S. PATENT DOCUMENTS

| | | | | |
|---|---|---|---|---|
| 4,450,335 | A | 5/1984 | Shimizu et al. | |
| 7,064,296 | B1 * | 6/2006 | Harned et al. | 219/391 |
| 2007/0267401 | A1 | 11/2007 | Collene et al. | |
| 2008/0030074 | A1 | 2/2008 | Duong | |
| 2009/0145031 | A1 | 6/2009 | Collene | |

FOREIGN PATENT DOCUMENTS

| | | | |
|---|---|---|---|
| CN | 201302204 | Y | 9/2009 |
| GB | WO2009080229 | A2 | 12/2007 |
| KR | 960013116 | B1 | 9/1996 |
| KR | 970011179 | B1 | 7/1997 |

* cited by examiner

*Primary Examiner* — Shawntina Fuqua
(74) *Attorney, Agent, or Firm* — James E. Howard; Andre Pallapies

(57) ABSTRACT

A home appliance that includes a power operated door includes a first sensor that is accessible to a user when the door is closed, and a second sensor that is accessible to the user when the door is open. The first sensor is used to cause the door to move from the closed position to the open position. The second sensor is used to cause the door to move from the open position to the closed position. The first sensor may be located on an exterior of the door and the second sensor may be located on an inner surface of the home appliance or on an inner surface of the door itself.

20 Claims, 10 Drawing Sheets

MOTORIZED HOME APPLIANCE DOOR

BACKGROUND

Ovens having hinged doors are known in the art. The hinges can be located at the bottom, the side or at the top of the door. Traditionally, oven doors have been moved between the open and closed position manually. More recently, however, some ovens include drive units and operating switches that can be used to cause the door to move automatically between the open and closed positions.

Some ovens with power operated doors include a switch that controls a drive mechanism used to open and/or close the oven door. When a user actuates the switch, the door to the oven may open automatically. A user may then place food into the oven and actuate the same switch to cause the oven door to close automatically.

SUMMARY

The inventors of the instant application realized that with conventional automatic doors, the location of a door switch may be convenient in one circumstance but not in other circumstances. For example, a cook getting ready to place a 30 lb turkey in an oven may activate a switch located on the front surface of the oven door to cause the door to open. However, once the door is open and the turkey has been placed inside the oven, the switch located on the front surface of the door may no longer be in a convenient location for easy activation to cause the door to close.

One aspect of the technology herein may be embodied in a home appliance that includes a drive unit that is operable to move the door between the open and closed positions.

The home appliance may include a sensor that facilitates opening and closing of the door.

Another aspect of the technology relates to disposing a sensor on an inner portion of a home appliance. For example, the sensor may be disposed on an inner surface of the door of the home appliance or it may be disposed on an inner surface of the home appliance surrounding the enclosure. In another aspect multiple sensors may be disposed at multiple portions of the inner portion of the home appliance.

Yet another aspect of the technology relates to providing a home appliance with a sensor that is configured to signal a drive unit to move a door to a closed position. Alternatively, or in addition, a sensor may be configured to cause a door to move to an open or closed position.

In some examples, at least two sensors are disposed on an interior portion of a home appliance and activating either sensor may cause the door to move to a closed position. One or all of the sensors may be covered when a door the home appliance is in a closed position.

In some examples, one or more sensors are located on an outer portion of a home appliance. The outer portion may include an outer surface of a door such that the sensors are disposed on the outer surface of the door. Activating the sensor may signal a drive unit to move a door of the home appliance to an open position.

Some examples may include a sensor on an outer portion of a home appliance and a sensor on an inner portion of the home appliances the sensors being positioned such that the sensors are substantially aligned when the door is in the closed position.

In some examples, additional functionality in a home appliance beyond opening or closing a door may be activated when a sensor is triggered.

Another aspect of the technology involves triggering a sensor in response to moving a door of a home appliance a certain distance. This can include moving a door of a home appliance in a closing direction to cause a sensor to trigger the opening of the door.

In some examples, a home appliance includes a vent to facilitate temperature control of a heated enclosure of the home appliance. A sensor may be positioned adjacent the vent such that the sensor is cooled by the vent when the home appliance increases in temperature.

Sensors in examples may use capacitive, piezoelectric, light sensors.

In examples where a door moves automatically between open and closed positions door movement may be halted when a certain resistance to opening the door is detected.

In certain embodiments a home appliance with an enclosure has a door that is moveable between open and closed positions. A first sensor may be disposed on an outer surface of the door such that when it is activated, the door opens. A second sensor may be disposed on the enclosure such that the door of the home appliance covers the second sensor when the door is in a closed position. The second sensor, when activated, may cause the door to move to the closed position.

DETAILED DESCRIPTION

The following description is provided in relation to several examples which may share common characteristics, features, etc. It is to be understood that one or more features of any one example may be combinable with one or more features of other examples. In addition, single features or a combination of features may constitute an additional embodiment(s).

Figure 1A:
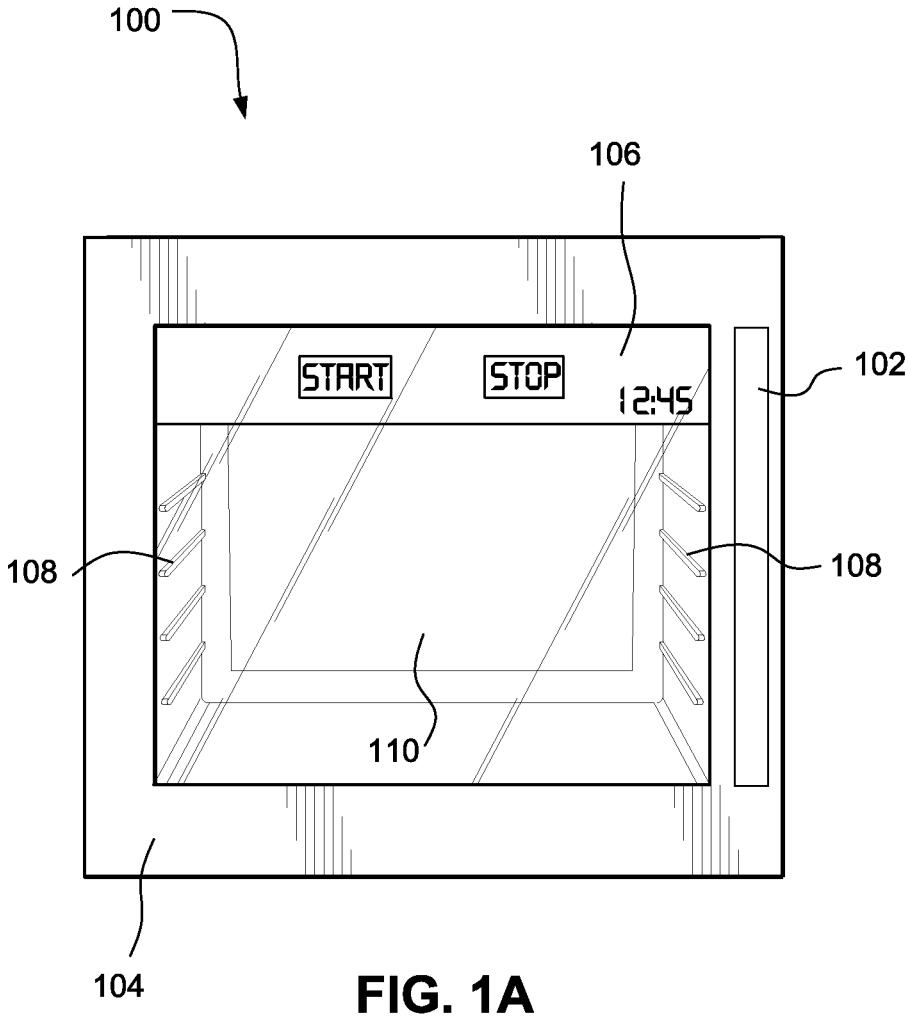
FIGS. 1A-1C illustrate different embodiments of home appliances with doors in a closed position.
Figure 1B:
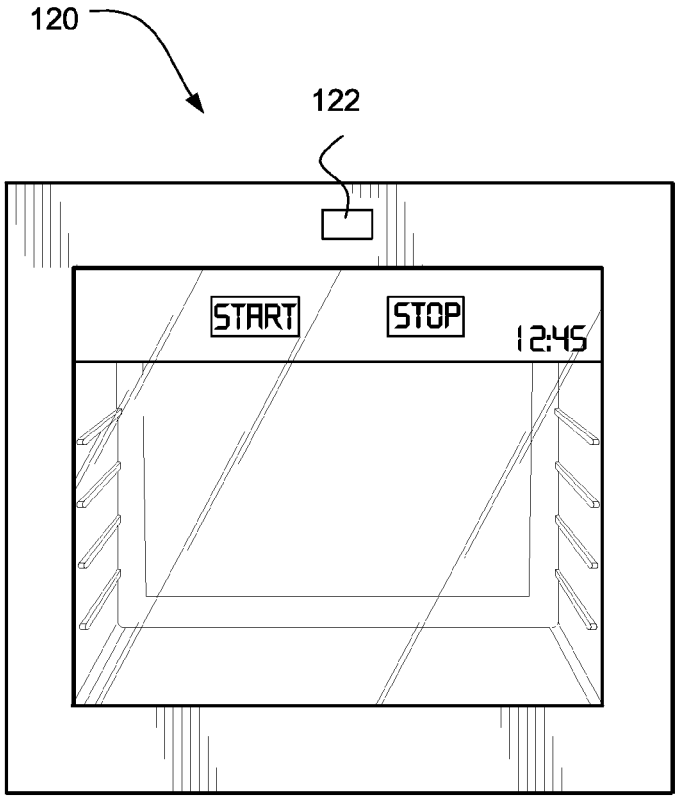
Figure 1C:
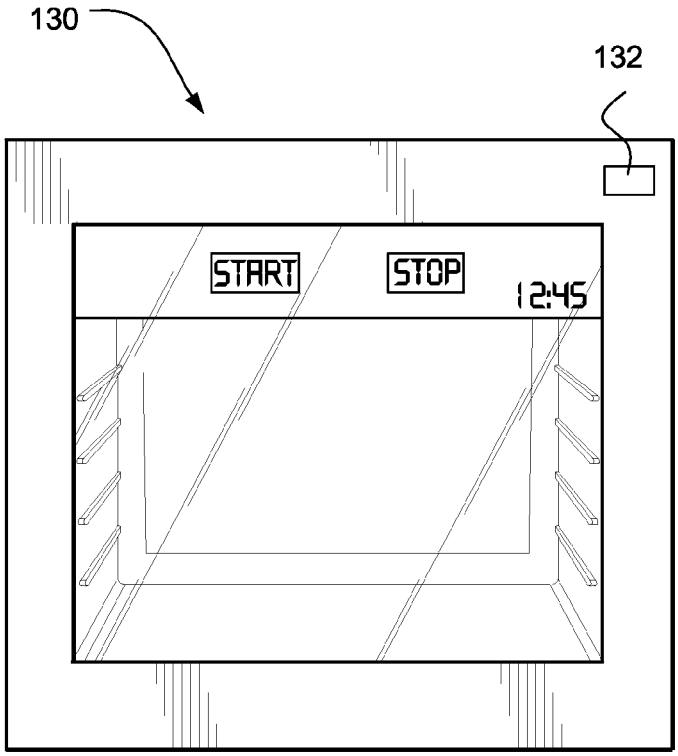

FIGS. 1A-1C illustrate three embodiments of an oven having a door that can be automatically opened and shut with a drive mechanism.

In the embodiment illustrated in FIG. 1A a door 104 of the oven is in a closed position. The oven 100 includes a series of rails 108 located on sidewalls of the cooking cavity that are configured to support an oven rack (not shown). The oven door 104 substantially seals the cooking cavity when the door 104 is in the closed position.

The door 104 may include a partially or substantially transparent viewing panel 110 that may, for example, be constructed out of glass. In certain other example embodiments, a non-translucent material may be used for the front of the door.

An instrument panel 106 that may provide information and allow control of the oven is located on the top of the front surface of the door 104. For example the instrument panel 106 may have a start button, a stop button, and may display the current time. Buttons, control switches and displays used to control various functions may also be included on the instrument panel 106. In alternate embodiments, the instrument panel 106 could be located not on the door, but on a non-moving surface of the oven housing. In the embodiment illustrated in FIG. 1A, the front surface of the door comprises the entire front face of the home appliance when the door is in the closed position. As a result, in this embodiment, the instrument panel is located on the front surface of the door.

The oven 100 includes a first sensor 102 on a side, e.g., the right side, of the door which is used to trigger the door 104 to automatically open. The first sensor 102 could be, for example, a capacitive sensor, an ambient light sensor, a piezoelectric sensor, or any other type of suitable sensor that allows a user to touch the sensor to instruct the door to automatically open.

When a user activates the first sensor 102 on the oven door, a signal is communicated to a drive mechanism that causes the door to move from the closed position to the open position. As is well known to those of ordinary skill in the art, various types of motors and drive mechanisms may be used to provide mechanical control over the position of the door.

The drive mechanism may cause the door to open to a preprogrammed position such that a user may then access the cooking cavity inside of the oven. The position to which the door opens, the speed of the door movement and various other aspects of door movement may be predetermined. In alternate embodiments, the user may be able to set these door opening parameters.

In the embodiment illustrated in FIG. 1A, the first sensor 102 is an elongated area on the right side of the door 104. Touching any portion of this sensor will cause a signal to be sent to the door drive mechanism to cause the door to open. In alternate embodiments, the first sensor could include a mechanical mechanism that must be physically depressed to trigger the door to open. Also, in alternate embodiments, the area occupied by the first sensor could be much smaller than is shown in FIG. 1A, or it could be larger. Further, the shape and location of the first sensor 102 can vary to suit the particular oven, or to conform to user preferences or aesthetic considerations.

In examples an oven may include a heating element (e.g., a burner) disposed on a lower portion of a cooking cavity in the oven. The heating element disposed on a lower portion of the cooking cavity may facilitate the baking or roasting of food placed into the oven. Alternatively, or in addition, an oven may include a heating element disposed on a top portion of the cooking cavity. Such an upper heating element may allow food placed into the oven to be "broiled." An oven may include a fan disposed in the cooking enclosure to facilitate the movement of hot air around the cooking enclosure. This convection process may speed up the cooking of food placed into an oven.

The heating elements for an oven may be hooked up to an electrical grid or may be connected to another heating source such as natural gas, propane, or the like. The heat provided by heating elements disposed in a cooking cavity of an oven may be controlled by a thermostat provided on an outer surface of the oven. Accordingly, users may control the temperature of the cooking cavity. Control of temperature or other oven functionality (e.g., whether the upper broiler burners are on) may be provided by mechanical switches, electrical connections, or the like. Control may be presented to the user in the form of mechanical dials, a touch screen, etc. In certain instances (e.g., an oven with a touch screen), the oven may require an electrical connection to power certain features of the oven.

In certain examples, an oven may include a timer that allows timed control of oven functionality. For example, an oven may have a timer that sets the oven to "bake" at 425° for 30 minutes. After 30 minutes the timer may automatically cause the oven to turn off. In certain examples an oven may include preset cooking times for a variety of different types of food (e.g., 350° for 15 minutes for steak or 425° for 12 minutes for salmon).

Certain example ovens may include an auto-clean functionality. One technique for accomplishing this is to oxidize the organic matter in the cooking cavity through use of extreme heat (e.g., at a temperature in excess of 500° F.).

In other examples, an oven may be a microwave oven that uses microwave radiation to heat food. An example microwave oven may include a magnetron used to convert electrical energy into microwave radiation. In certain examples, a microwave oven may include a stirrer and/or a turntable to facilitate even distribution of microwave energy. In certain examples, a microwave oven may also include a convection process.

An oven may also include one or more racks that may be inserted into the oven. The racks may help in adding or removing food from the cooking cavity of the oven.

The subject technology may also be applied to other types of home appliances. For example, another type of home appliance is a dishwasher. A dishwasher may include one or more racks for placing items to be washed in the dishwasher. In examples a dishwasher may be connected to a water source. In certain examples a dishwasher may include a heating element for heating items within the dishwasher to speed up the drying process after the items have been washed.

In certain examples, a home appliance (e.g., an oven or a clothes dyer) may require electricity to be supplied at a higher than normal household voltage. For example, an electrical connection of 240V may be preferred or required over a standard 120V connection.

In examples, a home appliance may be configured to receive one item or multiple items into an enclosure of the home appliance. The received item(s) may then be subject to a function performed by the home appliance (e.g., cooking food for an oven, drying clothes for a clothes dryer or washing dishes for a dish washer). In certain examples, a home appliance may perform multiple functions on the items located within the enclosure. For example, a dishwasher may wash and then dry dishes located within the enclosure.

FIG. 1B shows a first alternate embodiment in which the first sensor 122 is much smaller than the one illustrated in FIG. 1A. In this embodiment, the first sensor 122 is located at the center of the top of the front surface of the oven door.

In the embodiment illustrated in FIG. 1C the first sensor 132 is disposed in the upper right corner of the front surface of the oven door.

In other embodiments, the first sensor could be located on the viewing panel 110 at the center of the front surface of the oven door. In still other embodiments, the first sensor could be located on a side, top or bottom surface of the door or the oven housing. The first sensor could be located at virtually any location in which it can be conveniently operated by a user when the door is in the closed position.

Figure 2A:
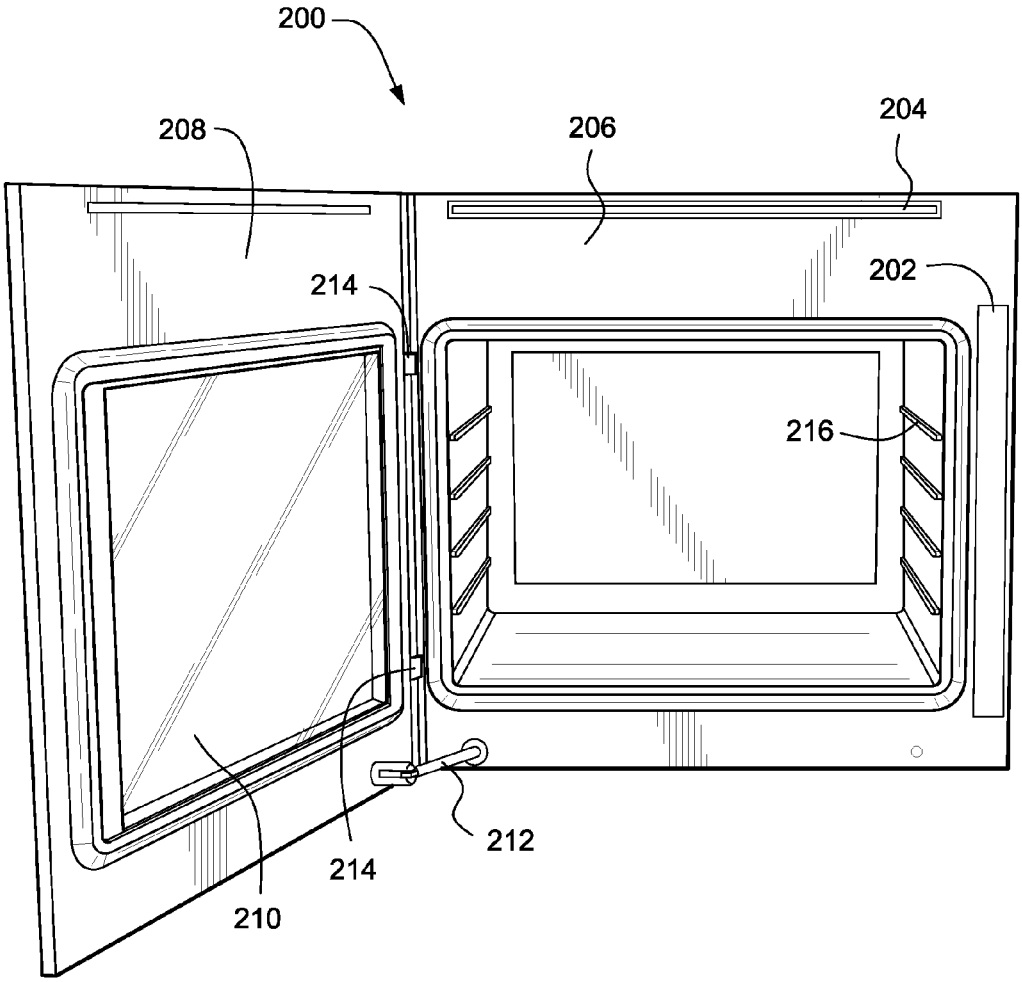
FIGS. 2A-2F illustrate various different embodiments of home appliances with doors in an open position.

FIG. 2A illustrates an oven such as the ones illustrated in FIGS. 1A-1C with the door in the open position. Once the door has moved to the open position, a front surface 206 surrounding the cooking cavity may be exposed. A vent 204 may be located along the top of the front surface 206, the vent facilitating cooling of the oven, the front surface 206 and the corresponding surface on the back of the door.

Hinges 214 attach the door 208 to the main body of the oven to allow the door 208 to move between and open and closed positions. The drive mechanism that controls movement of the door may include a powered arm assembly 212 that controls the position of door 208. Accordingly, when the drive mechanism is activated, the powered arm assembly 212 may position the door in an open position, a closed position, or some position between the open and closed positions.

In the embodiment illustrated in FIG. 2A, a second sensor 202 is located on the far right side of the front surface 206 of the enclosure of the oven 200. The second sensor 202 is activated by a user to instruct the drive mechanism to cause the door to move from the open position to the closed position. The second sensor 202 could be similar to the first sensor located on the front of the oven, or it could be a different type of sensor. Regardless, a user will be able to activate the second sensor 202 to instruct the drive mechanism to close the door.

When the door of the oven is closed, the front surface 206 and the second sensor 202 will be covered by the door. In some instances, the second sensor 202 will be located on the front surface 206 such that it is essentially directly behind the first sensor when the oven door is closed. When the first and second sensors are located in this fashion, a user would be touching substantially the same location on the oven to cause the door to open and to cause the door to close. For similar reasons, the size and shape of the second sensor 202 may be substantially the same as the size and shape of the first sensor 102.

Figure 2B:
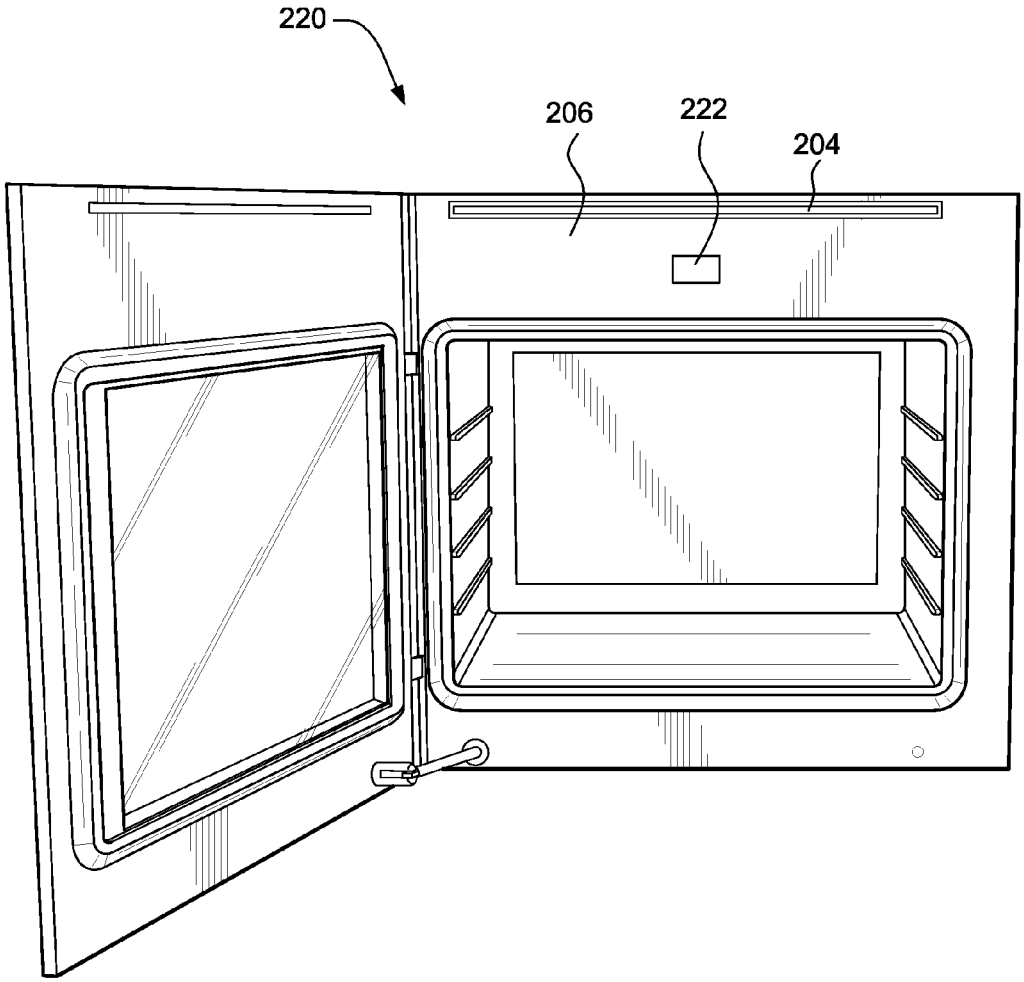

In the embodiment illustrated in FIG. 2B, the second sensor 222 used to instruct the door to close is located on the upper middle portion of the front surface 206 of the enclosure of the oven 220. If the first sensor used to cause the door to open is located as illustrated in FIG. 1B, this would place the second sensor directly behind the first sensor when the oven door is closed. Further, in this embodiment, the second sensor 222 is disposed near the cooling vent 204. Such a placement may facilitate cooling of the second sensor 222, even if other portions of the front surface 206 become hot. This would ensure that the user can comfortably operate the second sensor, even when the cooking cavity is at an elevated temperature.

Figure 2C:
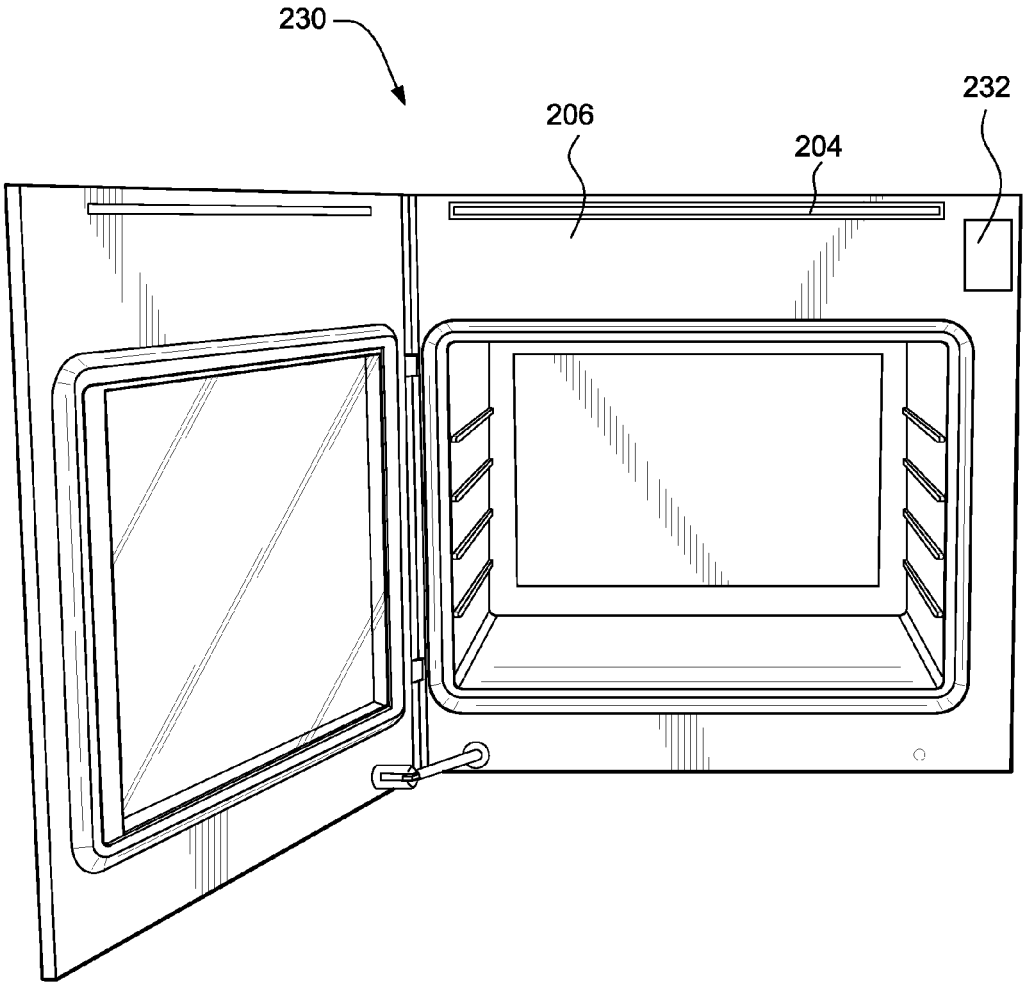

In the embodiment illustrated in FIG. 2C, a second sensor 232 is located in the upper right corner of the front surface 206 of the enclosure. If a first sensor 132 used to cause the door to open were located as illustrated in FIG. 1C, placing the second sensor as illustrated in FIG. 2C would ensure that the second sensor 232 is located directly behind the first sensor 132. In addition, because the second sensor 232 is located adjacent the outer edge of the front surface 206, and adjacent the vent 204, the second sensor could be kept cooler than if it were located closer to the cooking cavity.

Figure 2D:
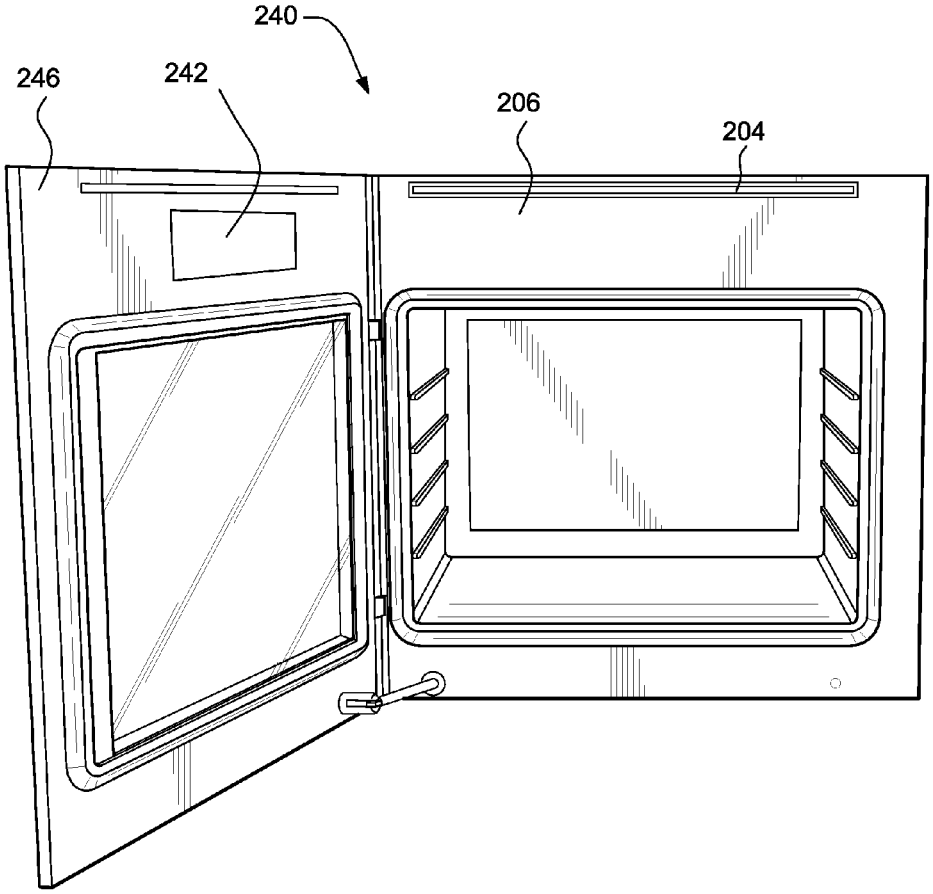

In the embodiment illustrated in FIG. 2D, a second sensor 242 used to cause the door to close is located on an inner surface 246 of the door. When the second sensor is placed in this location, the wiring requirements for the sensors may be reduced because the first and second sensors would be located on opposite sides of the door. In addition, when the second sensor 242 is located as illustrated in FIG. 2D, the second sensor 242 is also positioned adjacent the vent when the door is closed, which would help to keep the second sensor 242 cool.

Figure 2E:
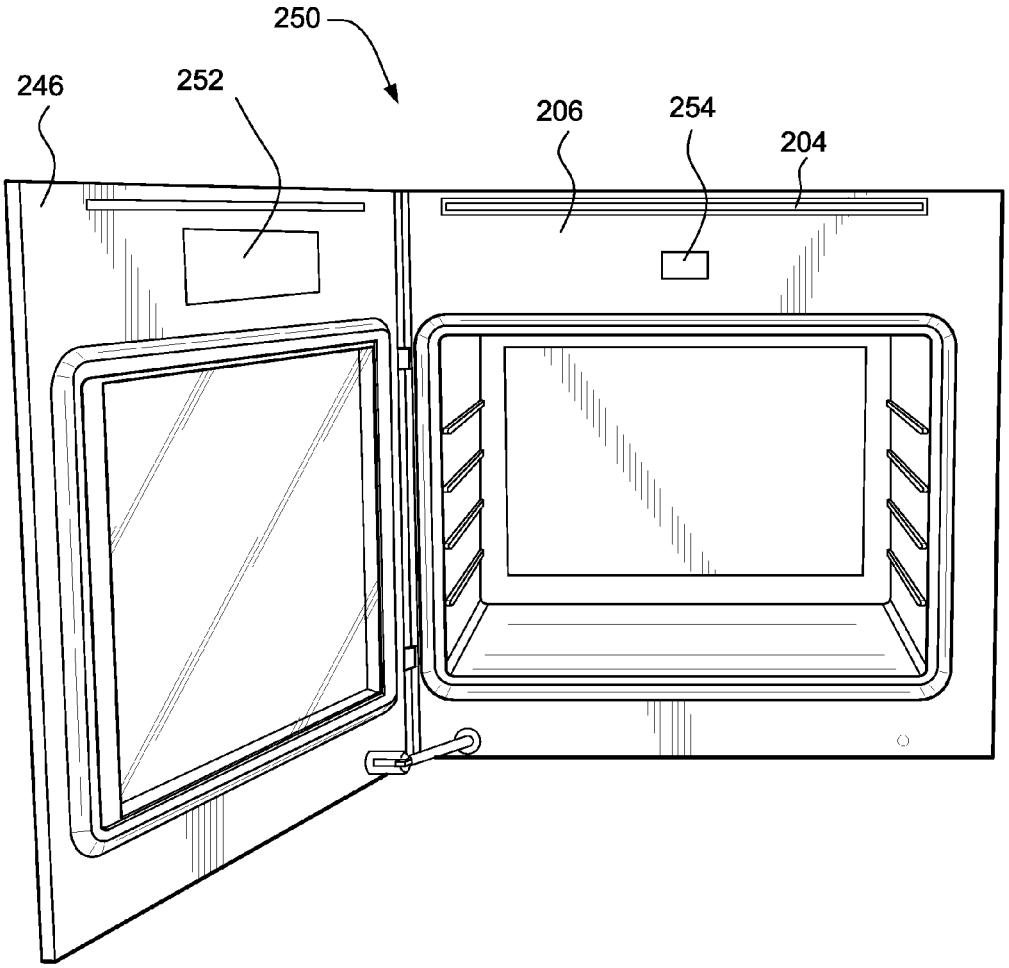

In the embodiment illustrated in FIG. 2E, second sensors 252 and 254 used to cause the door to close are located, respectively, on an inner surface 246 of the door and on a front surface 206 of the oven above the cooking cavity. A user could activate either of the second sensors 252, 254 to cause the door to close. Such an arrangement of sensors would give a user more options for how the closing of a door may be controlled.

Figure 2F:
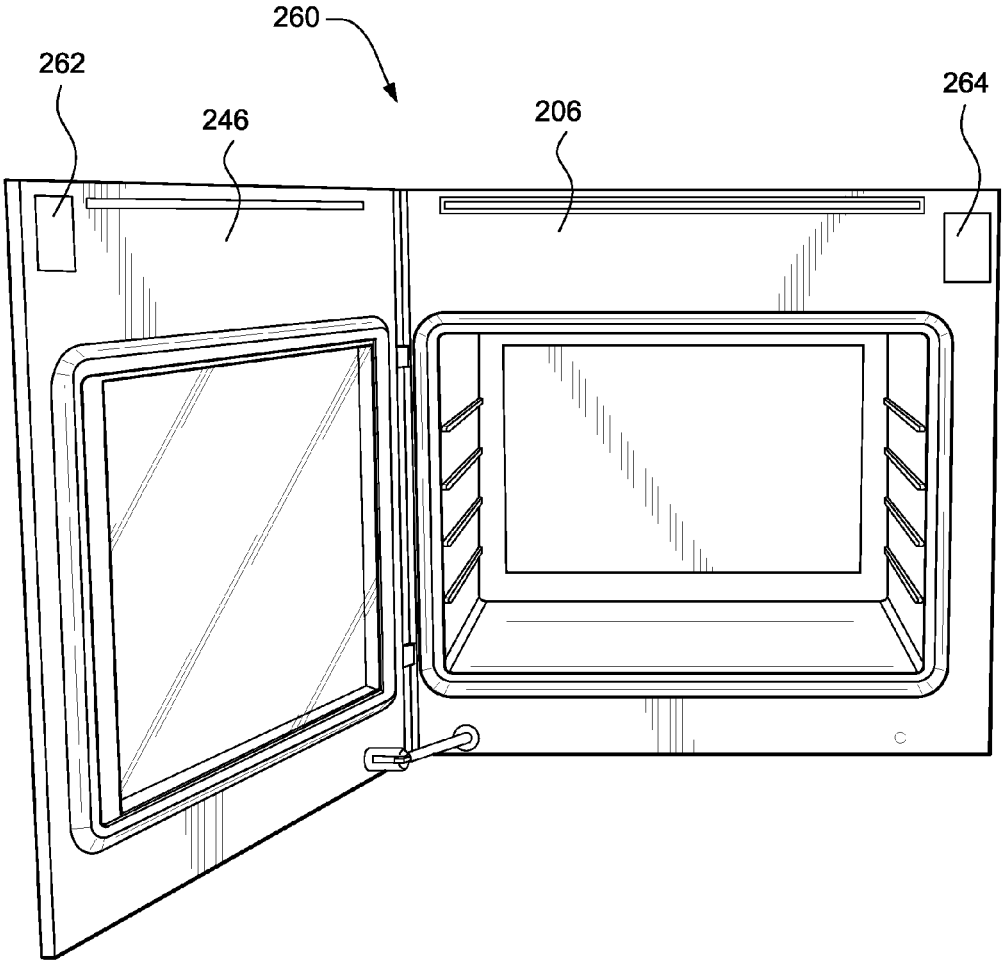

In the embodiment illustrated in FIG. 2F, second sensors 262 and 264 are located, respectively, on the upper left corner of the inner surface of the door 246 and in the upper right corner of the front surface 206 of the oven. Here again, a user could activate either of the second sensors 262, 264 to cause the oven door to close. This may be beneficial for users because the location of the first sensor 132 on the front of the door, such as is illustrated in FIG. 1C, and the positions of the first and second sensors 262, 264 would be substantially similar when the door is in an open and closed position.

In alternate embodiments, first and second sensors may be disposed in different locations and/or more than two sensors may be positioned on the front face of the door, the rear face of the door, or the front face of the oven.

In certain embodiments the sensors of a home appliance may also be used to determine when the door to the home appliance reaches the open and/or closed position. For example, the second sensors 262 and 264, being opposite one another when the door is closed, may be configured to sense each other when the door is moved into the closed position. Accordingly, one or both of the sensors may send a signal to the drive unit to stop closing the door. In other embodiments, an inner sensor (e.g., second sensor 232) may be configured to sense the surface that is opposite the sensor (e.g., the inner surface of the door or the front surface of the oven) and send a signal to the drive unit to stop closing the door.

Figure 3A:
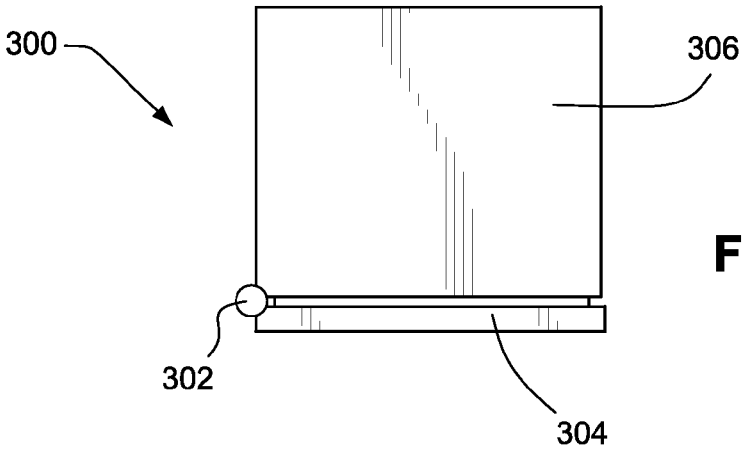
FIGS. 3A-3C are top views of a home appliance illustrating how a user can cause a door to automatically open.
Figure 3B:
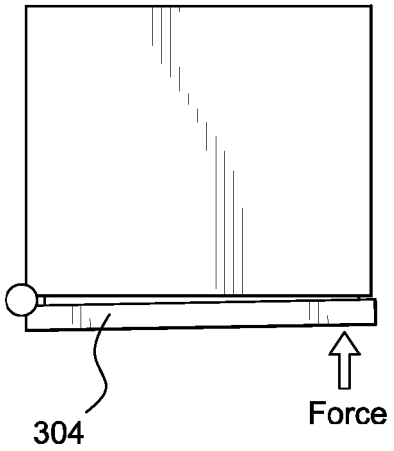
Figure 3C:
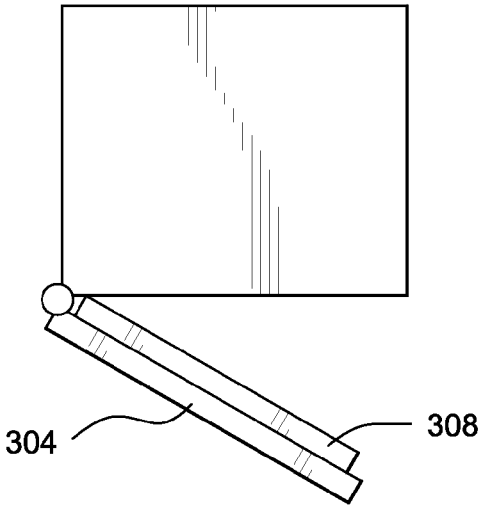

FIGS. 3A-3C are top views of an exemplary home appliance illustrating how an alternate door opening mechanism would operate. A home appliance 300 includes a door 304 connected by a hinge 302 to an enclosure 306. Thermal padding or a seal 308 may be located between the inner surface of the door 304 and the enclosure.

A sensor (not shown) may be disposed in the home appliance to sense movement of the door 304. In FIG. 3A the door 304 is located at a closed position. In FIG. 3B a user pushes on the front face of the door 304 to apply a force that moves the door in the closing direction. As illustrated in FIG. 3B, this causes the door to move slightly in the closing direction. When this occurs, the sensor on or within the home appliance 300 detects the movement of the door 304. In some embodiments, the sensor could detect movement of the door of between about 0.5 mm and 2 mm.

Once the sensor within the oven detects a predetermined amount of movement of the door 304 in the closing direction (e.g., 1 mm in the closing direction), the sensor sends a signal to a drive unit that causes the door to move to the open position. Accordingly, as shown in FIG. 3C, the door 304 moves toward an open position.

In some embodiments, the sensor may also be used to trigger the drive mechanism to cause the door to close. In these embodiments, if the door is in an open position, and the user moves the door slightly, the sensor would send a signal to the drive mechanism to cause the door to close. The slight movement of the door detected by the sensor could be movement in either the opening or the closing direction.

Figure 4:
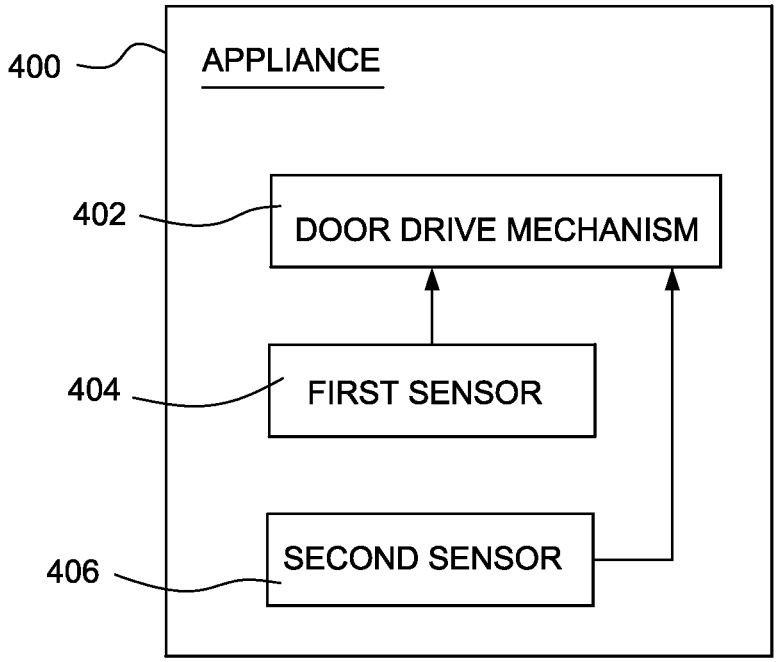
FIG. 4 is a block diagram of portions of a home appliance.

FIG. 4 is a block diagram that illustrates various elements of a home appliance 400 such as the ones illustrated above. The home appliance 400 includes a door drive mechanism 402 that is used to cause a door of the home appliance to move between open and closed positions. The home appliance also includes a first sensor 404 coupled to the drive mechanism 402 to instruct the drive mechanism 402 to cause the door to open. In some embodiments, such as the ones illustrated in FIGS. 1A-1C, the first sensor 404 could be one of the first sensors that is accessible to a user when the door is closed. In other embodiments, such as the one discussed above in connection with FIGS. 3A-3C, the first sensor 404 could be a sensor within a home appliance that senses when a user has pushed on a door of the home appliance to cause it to move slightly.

The home appliance may also include a second sensor 406 that is also coupled to the drive mechanism 402. The second sensor is used to instruct the drive mechanism to cause the door to move to the closed position. The second sensor could be one of the second sensors discussed above with respect to FIGS. 2A-2F, which is accessible to the user when the door is in the open position. In the context of the embodiments illustrated in FIGS. 3A-3C, the second sensor could sense when the user has caused the door to move slightly when it is in the open position. This could mean that the second sensor is different from the one used to sense movement when the door is in the closed position. In still other embodiments, a single sensor could sense when a user causes the door to move slightly, regardless of whether the door is in the open or closed positions.

The above-described embodiments may relate to an oven with a door that opens and closes a cooking cavity. However, a similar door drive mechanism and switch arrangement could be used on other types of home appliances. For instance, the drive mechanism and switch arrangement could be used on a microwave oven, an ice maker, a dishwasher, a refrigerator and/or freezer, a clothing washer, a clothing dryer, a trash compactor or other typical household or domestic appliance that includes a door.

In some embodiments a door may be connected to a main body of a home appliance by one or more hinges. In alternate embodiments, the door may be moveably connected to the main body by another technique. For example the door could be slidably connected to the main body such that it slides between an open position and a closed position.

In some embodiments, the area of the sensors that can be touched to activate the sensor may be demarked by one or more lines that define the area in which the sensor is located. In other embodiments, the sensor area may not be so marked, but instead may blend in with the surrounding surface (for example, the surface of the door) upon which it is located.

In some embodiments, the sensors may be used to cause additional functions to occur, in addition to instructing a door to open and/or close. For example, if the first and second sensors are located on a dishwasher, a user loading a dishwasher may simply wish to hit a button to cause the dishwasher door to close and to cause a dishwashing operation to begin. Accordingly, a sensor disposed on an inner surface that is accessible when the dishwasher door is open may cause both operations to occur (e.g., closing of the dishwasher door followed by a starting of the dishwashing operation).

Some embodiments may include a safety mechanism that stops movement of a door if an obstruction is encountered during an opening or closing operation. In such embodiments, if the door is opening or closing and the drive mechanism encounters a certain level of resistance, the door would automatically stop. The door might also automatically reverse direction for a small amount of travel, or the door might reverse direction and return to the position it occupied before the movement operation began. This type of safety mechanism could prevent damage to the drive mechanism itself, injury to the operator or a bystander, or the destruction of some item that has been placed in the movement path of the door. In other embodiments the safety mechanism may use the sensors disposed on the home appliance to detect objects before the door hits the objects.

While the invention has been described in connection with what are presently considered to be the most practical and preferred examples, it is to be understood that the invention is not to be limited to the disclosed examples, but on the contrary, is intended to cover various modifications and equivalent arrangements.

What is claimed is:

1. A home appliance, comprising:

an enclosure;

a door connected to the enclosure, the door movable between an open position and a closed position;

a door drive unit that is operable to move the door between the open position and the closed position;

a first sensor disposed on an outer portion of the home appliance, wherein when the first sensor is activated, the first sensor signals the door drive unit to move the door to the open position; and a second sensor disposed on an inner portion of the home appliance, wherein when the second sensor is activated, the second sensor signals the door drive unit to move the door to the closed position.

2. The home appliance of claim 1, wherein the first sensor is disposed on an outer surface of the door.

3. The home appliance of claim 1, wherein the second sensor is disposed on an inner surface of the door.

4. The home appliance of claim 1, wherein the second sensor is disposed on a surface of the enclosure that is covered by the door when the door is in the closed position.

5. The home appliance of claim 4, further comprising a vent disposed on the surface of the enclosure, and wherein the second sensor is cooled by the vent when the body of the home appliance increases in temperature.

6. The home appliance of claim 4, further comprising a third sensor disposed on an inner surface of the door, wherein when the third sensor is activated, the third sensor signals the door drive unit to move the door to the closed position.

7. The home appliance of claim 1, wherein the first sensor and the second sensor are substantially aligned when the door is in the closed position.

8. The home appliance of claim 1, wherein the activation of the first sensor or the second sensor triggers an additional function in the home appliance.

9. The home appliance of claim 1, wherein the first sensor is activated when a user causes the door to move a predetermined distance when the door is in the closed position.

10. A home appliance, comprising:

an enclosure having an opening;

a door connected to the enclosure, the door being movable between a closed position and an open position;

a first sensor disposed on an outer surface of the door, wherein when the first sensor is activated the door moves to the open position; and a second sensor disposed on the enclosure, wherein when the second sensor is activated the door moves to the closed position, and wherein when the door is in the closed position, the door covers the second sensor.

11. The home appliance of claim 10, further comprising a third sensor disposed on an inner surface of the door, wherein when the third sensor is activated, the door moves to the closed position.

12. The home appliance of claim 11, wherein when the door is in the closed position, a user cannot access and activate the third sensor.

13. The home appliance of claim 10, wherein the first sensor is activated when a force is applied to an outer surface of the door and moves the door in a closing direction.

14. The home appliance of claim 10, wherein the second sensor is located substantially behind the first sensor when the door is in the closed position.

15. The home appliance of claim 10, wherein the second sensor is a capacitive sensor.

16. The home appliance of claim 10, wherein the second sensor is a piezoelectric switch.

17. The home appliance of claim 10, wherein the second sensor is an ambient light switch.

18. A home appliance, comprising:

an enclosure having an opening;

a door connected to the enclosure, the door being movable between a closed position in which the door closes the opening and an open position in which the door exposes the opening;

a door drive unit that moves the door between the open and closed positions; and a sensor disposed on the enclosure, wherein, when the sensor is activated, the sensor signals the door drive unit to move the door to the closed position, and wherein when the door is in the closed position the door covers the sensor.

19. The home appliance of claim 18 wherein the sensor disposed on the enclosure comprises a first sensor, and further comprising a second sensor disposed on an inner surface of the door, wherein when the second sensor is activated, the second sensor signals the door drive unit to move the door to the closed position.

20. The home appliance of claim 19, wherein the door stops closing when at least one of the first sensor and the second sensor detect the presence of the other sensor.

* * * * *